United States Patent [19]

Bove'

[11] 4,241,547

[45] Dec. 30, 1980

[54] RAINWATER DUCTING SYSTEM

[76] Inventor: Louis J. Bove', 10131 Epsilon Rd., Richmond, Va. 23235

[21] Appl. No.: 28,475

[22] Filed: Apr. 9, 1979

[51] Int. Cl.[3] ..... E04D 13/00

[52] U.S. Cl. ..... 52/11; 52/16

[58] Field of Search ..... 52/11, 12, 16

[56] References Cited

U.S. PATENT DOCUMENTS

| | | | |
|---|---|---|---|
| 3,638,369 | 2/1972 | Albrecht | 52/16 |
| 4,014,074 | 3/1977 | Faye | 16/128 R |
| 4,061,151 | 12/1977 | Ward | 52/12 X |

*Primary Examiner*—Carl D. Friedman

*Attorney, Agent, or Firm*—Norman B. Rainer

[57] ABSTRACT

A rainwater ducting system mounted adjacent the eaves of a building is comprised of a horizontally disposed open gutter containing horizontally directed auger means and a communicating downspout containing vertically directed auger means. The auger means are designed to occlude less than 50% of the cross sectional area of the trough and downspout, and are separately activated by waterproof motors remotely controlled and adapted to provide variable forward and reverse speeds. In operation, the auger means advance solid debris toward and downward through said downspout.

7 Claims, 6 Drawing Figures

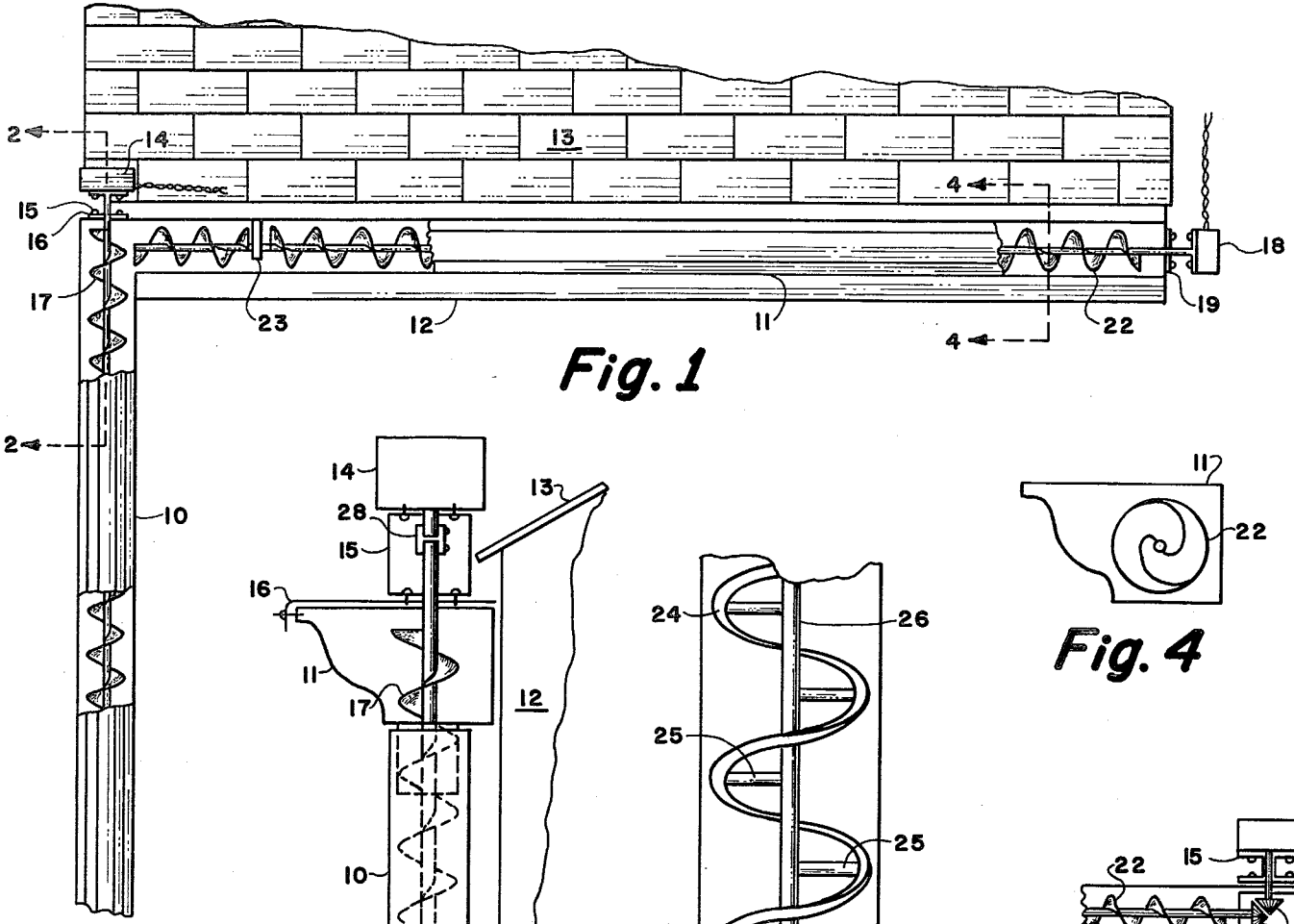
Fig. 1
Fig. 4
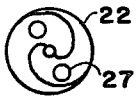
Fig. 5
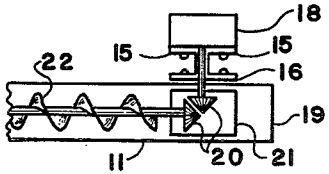
Fig. 6
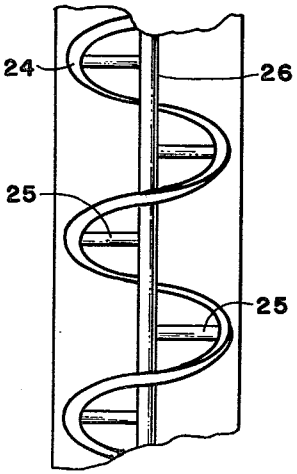
Fig. 3
Fig. 2

RAINWATER DUCTING SYSTEM

BACKGROUND OF THE INVENTION

This invention relates to rainwater ducting systems mounted adjacent the eaves of buildings, and more particularly to improvements in such systems wherein removal therefrom of accumulated solid debris is efficiently achieved to prevent obstruction of said ducting system.

Most roof structures utilized on houses and other buildings are pitched or sloped to prevent the accumulation of water on the roof. In order to prevent the rain water which runs off a pitched roof from seeping into the foundation of the building, a gutter is generally mounted just under the terminal edge of the roof, known as the eaves, to catch the water and conduct it to a downspout which directs the water away from the building.

In the course of time, however, such gutters become clogged with leaves, twigs and other solid debris which are propelled into the gutter either by the action of the water running off the roof, or by the wind. When enough of such debris accumulates, it interferes with or eliminates the proper functioning of the gutter.

Numerous approaches have been earlier tried in efforts to solve this problem, but none have been completely successful. For example, U.S. Pat. Nos. 3,080,682; 3,295,264; 3,388,555 and 3,428,183 employ sieving means, generally positioned above the gutter, to separate the debris from the water before entrance into the gutter. One problem with this approach is that the screens or perforations utilized to achieve the sieving become obstructed themselves, and lose their functionality. Another problem is that a considerable quantity of fine material penetrates the sieve to enter and accumulate in the gutter.

U.S. Pat. Nos. 4,014,074 and 4,061,151 disclose gutters which can be inverted so as to dump their contents onto the ground below them. Such systems scatter the debris about the host building and may imperil the operator standing below.

U.S. Pat. Nos. 2,669,950 and 2,873,700 relate to shield devices having curved projections which cause solid debris to fall to the ground while directing water into an underlying gutter. However, during periods of heavy rain, such devices may not adequately accomodate water at the required rate of flow.

U.S. Pat. No. 3,638,369 concerns the use of a wind driven auger means to propel solid debris downward through a downspout. Although the device may function well with leaves, twigs may interfere with movement of the auger. The device also makes no provision for cleaning the horizontally disposed gutters leading to said downspout.

It is accordingly an object of the present invention to provide apparatus for cleaning solid debris from the gutters and downspout of the ducting system associated with the eaves of a building.

It is a further object to provide apparatus of the aforementioned nature resistant to obstruction by said debris, and having an undimished capacity for handling rainwaters at a high flow rate.

Other objects and advantages will become apparent in the course of the following detailed description.

SUMMARY OF THE INVENTION

The objects of the present invention are accomplished in general by providing a system of apparatus for the removal of debris from a gutter and communicating downspout comprising horizontally disposed auger means positioned within said gutter, and vertically disposed auger means positioned within said downspout, both said auger means being driven by electric motors capable of variable forward and reverse speeds. Said motors are of waterproof construction and provided with control means remote therefrom. The augers are configured and positioned in a manner such that they do not obstruct more than 50% of the cross sectional area of the gutter or downspout. The auger means utilized in said downspout is directly coupled to the shaft of an electric motor positioned above said gutter. The motor which activates the auger means in said gutter may be positioned above said gutter and coupled by power transmission means to said auger means, or may be positioned on the same horizontal axis as said auger means and coupled thereto by a shaft which penetrates a close-fitting aperture in an end plate of said gutter. The end of the horizontally disposed auger means remote from the motor is rotatively supported by mounting means associated with said gutter.

BRIEF DESCRIPTION OF THE DRAWINGS

For a fuller understanding of the nature and objects of the invention, reference should be had to the following detailed description taken in connection with the accompanying drawing forming a part of this specification and in which the numerals of reference indicate corresponding parts in all the figures of the drawing:

FIG. 1 is a front elevational view of the apparatus of this invention shown in combination with a gutter and downspout mounted on the side of a building, partly broken away to show interior detail.

FIG. 2 is an enlarged fragmentary sectional view taken along the line 2—2 of FIG. 1.

FIG. 3 is an enlarged fragmentary view of an embodiment of auger means alternative to that shown in FIG. 1 positioned within a downspout.

FIG. 4 is an enlarged transverse view taken along the line 4—4 of FIG. 1.

FIG. 5 is an end view of another embodiment of auger means.

FIG. 6 is a fragmentary vertical sectional view of a gutter equipped with apparatus of this invention in a manner alternative to the embodiment of FIG. 1.

DETAILED DESCRIPTION OF THE PREFERRED EMBODIMENTS

Referring now to FIGS. 1 and 2, a rain water ducting system of the present invention is shown comprised of a tubular downspout 10 attached at its uppermost end to a horizontally disposed open trough gutter 11 attached to the fascia 12 of a building and positioned below the terminal edge of a shingled roof 13. A first electric motor 14 is supported above downspout 10 by bracket means 15 extending upwardly from attachment with shelf 16 resting in abutment with the upper edge of gutter 11. Downwardly directed auger means 17 depends from the shaft of said motor in axial alignment therwith, and extends downwardly within said downspout for at least $\frac{1}{3}$ the length thereof. Attachment of said auger means with said shaft is achieved by means of a standard collar 28.

A second motor 18 is associated with gutter 11 either in the manner depicted in FIG. 1 wherein the axis of the motor extends through end plate 19 of said gutter, or in the manner of the embodiment of FIG. 6 wherein said motor rests on shelf 16 above said gutter, and enmeshing gears 20 housed within enclosure 21 transmit rotative power to horizontally directer auger means 22.

Aligning support means such as bearing post 23 may be utilized in association with either auger means to ensure that the auger means is substantially centered within and avoids scraping contact with said downspout or gutter.

The term auger, as employed herein is intended to denote any elongated structure of substantially uniform cross sectional dimension wherein rotation about its longitudinal axis will generate propulsive forces directed coextensively with said axis. In general, devices having a screw-like twist, helix or spiral configuration are comtemplated. It is to be noted however, that tapered structures such as conical screws are not embraced by the scope of auger means useful in the present invention.

The embodiment exemplified in FIG. 3 may be termed a ribbon helix because a narrow flat band 24 having a spiral configuration is supported at a uniform distance from center shaft 26 by positioning struts 25 extending from said shaft. The advantage of the ribbon helix is that it causes minimal obstruction of the conduit in which it is positioned. In the configuration of auger exemplified in FIG. 5, holes 27 are provided to minimize the area occluded by said auger positioned within a conduit.

The first and second electric motors may be of identical construction. The motors are of a design which permits operation at variable speed, and reversal of direction. The variable speed capability is required to enable the motor to turn the auger means coupled thereto at relatively low rotative speed yet with adequate torque to displace solid debris. The variation in speed of the motor may be achieved primarily by use of a rheostat device electrically connected to said motor. The rheostat may in fact be associated with an on-off control switch located within the building on which the drain trough system is mounted. Preferably motors will be of the universal type and will have a horsepower rating in the range of $\frac{1}{8}$ H.P. to $\frac{1}{4}$ H.P. Motors of lower power may be used in conjunction with a gear system which converts high rotative speed into a low speed, high torque output. Any gear systems or other power transmission systems utilized with the apparatus of this invention require a protective enclosure to exclude solid debris and preferably also water. The reversible feature is necessry to enable the auger means to dislodge any solid debris of large size which may wedge between the outer periphery of the auger means and the conduit in which it resides. The motors useful in the practice of this invention should be provided with housings which prevent entrance of liquid phase water and moisture which could condense to liquid phase water within the motor enclosure.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A rainwater ducting system for use adjacent the eaves of a building comprising:

(a) a horizontally disposed open gutter trough located beneath the terminal edge of a roof of said building in a manner to receive rainwater therefrom, horizontally directed auger means positioned within said trough adapted for rotative movement therein without contact with the inside walls of said trough, a first electric motor supported by said trough and operatively coupled to said auger means, and (b) a vertically disposed tubular downspout communicating with said trough adjacent at least one end thereof, vertically directed auger means positioned within said downspout depending from attachment with a second electric motor mounted atop said trough and positioned directly above said downspout, (c) said horizontally directed and vertically directed auger means each occupying less than 50% of the cross-sectional areas of said trough and downspout respectively, (d) said first and second motors being of waterproof design and capable of variable forward and reverse speeds, and (e) electrical control means for said motors located within said building remote from said trough and downspout, (f) whereby activation of said motors causes the associated auger means to advance solid debris along said gutter to said downspout and thence downwardly through said downspout.

2. The rainwater ducting system of claim 1 wherein said horizontally directed and vertically directed auger means have the configuration of a ribbon helix.

3. The rainwater ducting system of claim 1 wherein said control means comprises an on-off switch, a rheostat, and means for reversing the direction of operation of said motors.

4. The rainwater ducting system of claim 1 wherein said vertically directed auger means extends downwardly within said downspout for at least $\frac{1}{3}$ the height thereof.

5. The rainwater ducting system of claim 1 wherein the axes of said auger means are coaxially coupled to the shafts of said motors.

6. The rainwater ducting system of claim 1 wherein the axis of said horizontally directed auger means is disposed at a right angle with respect to the shaft of said first motor, and coupled therewith by gear means.

7. The rainwater ducting system of claim 6 wherein said gear means are contained within a protective enclosure.

* * * * *